US005663612A

United States Patent [19]

Nuckolls

[11] Patent Number: 5,663,612

[45] Date of Patent: Sep. 2, 1997

[54] APPARATUS FOR DIMMING DISCHARGE LAMP HAVING ELECTROMAGNETIC REGULATOR WITH SELECTIVELY TAPPED CAPACITANCE WINDING

[75] Inventor: Joe A. Nuckolls, Etowah, N.C.

[73] Assignee: Hubbell Incorporated, Orange, Conn.

[21] Appl. No.: 637,966

[22] Filed: Apr. 30, 1996

[51] Int. Cl.[6] ..... H05B 37/00

[52] U.S. Cl. ..... 315/240; 315/320; 315/282; 315/291; 315/DIG. 4

[58] Field of Search ..... 315/291, 278, 315/282, 289, 307, 313, 320, 240, 267, DIG. 4, 224

[56] References Cited

U.S. PATENT DOCUMENTS

| | | | |
|---|---|---|---|
| 3,249,807 | 5/1966 | Nuchells | 315/199 |
| 3,317,789 | 5/1967 | Nuchells | 315/194 |
| 3,678,371 | 7/1972 | Nuchalls | 323/6 |
| 3,710,184 | 1/1973 | Williams | 315/227 |
| 3,793,557 | 2/1974 | Cramer | 315/199 |
| 3,857,060 | 12/1974 | Chermin | 315/99 |
| 3,917,976 | 11/1975 | Nuchells | 315/258 |
| 3,963,958 | 6/1976 | Nuchells | 315/276 |
| 3,997,814 | 12/1976 | Toho | 315/200 |
| 4,015,167 | 3/1977 | Samuels | 315/99 |
| 4,017,761 | 4/1977 | Woldring | 315/99 |
| 4,207,497 | 6/1980 | Capewell et al. | 315/96 |
| 4,209,730 | 6/1980 | Pasik | 315/290 |
| 4,378,514 | 3/1983 | Cullins | 315/276 |
| 4,399,391 | 8/1983 | Hammer et al. | 315/244 |
| 4,415,837 | 11/1983 | Sodini | 315/177 |
| 4,443,740 | 4/1984 | Garalnik | 315/284 |
| 4,538,092 | 8/1985 | Goralnik | 315/58 |
| 4,562,381 | 12/1985 | Hammer et al. | 315/99 |
| 4,626,745 | 12/1986 | Davenport et al. | 315/179 |
| 4,859,914 | 8/1989 | Summa | 315/354 |
| 4,866,347 | 9/1989 | Nuchalls et al. | 315/158 |
| 4,885,507 | 12/1989 | Ham | 315/244 |
| 4,891,562 | 1/1990 | Nuchalls et al. | 315/277 |
| 4,914,354 | 4/1990 | Hammer et al. | 315/247 |
| 4,958,107 | 9/1990 | Mattas et al. | 315/289 |
| 4,994,718 | 2/1991 | Gordin | 315/240 |
| 5,047,694 | 9/1991 | Nuchells et al. | 315/290 |
| 5,049,789 | 9/1991 | Kumar et al. | 315/289 |
| 5,055,747 | 10/1991 | Johns | 315/307 |
| 5,173,643 | 12/1992 | Sullivan et al. | 315/276 |
| 5,210,471 | 5/1993 | Nuchalls et al. | 315/289 |
| 5,216,333 | 6/1993 | Nuchalls et al. | 315/291 |
| 5,289,110 | 2/1994 | Slevinsky | 323/301 |
| 5,309,065 | 5/1994 | Nuchells et al. | 315/205 |
| 5,321,338 | 6/1994 | Nuchells et al. | 315/290 |
| 5,327,048 | 7/1994 | Troy | 315/240 |
| 5,406,174 | 4/1995 | Slegers | 315/219 |
| 5,477,113 | 12/1995 | Christoffersson | 315/278 |

FOREIGN PATENT DOCUMENTS

| | | |
|---|---|---|
| 52-18077 | 2/1977 | Japan . |
| 52-18078 | 2/1977 | Japan . |
| 52-49678 | 4/1977 | Japan . |
| 54-98066 | 8/1979 | Japan . |

OTHER PUBLICATIONS

Philips Lighting, "IFS 800 Lighting Control System" Oct. 1990.

RUUD Lighting, "There's One System that Makes Two Level Lighting Simple" 1993.

*Primary Examiner*—Robert Pascal
*Assistant Examiner*—Haissa Philogene
*Attorney, Agent, or Firm*—Jerry M. Presson; Stacey J. Longanecker

[57] ABSTRACT

An apparatus for dimming a discharge lamp is provided which comprises an electromagnetic regulator. The electromagnetic regulator has a primary winding connected to an AC power supply, a secondary winding connected to the lamp, and a tertiary winding. A capacitor is selectively connected to a tap on the tertiary winding via a switching device for dimming purposes.

7 Claims, 3 Drawing Sheets

| OPERATING CHARACTERISTICS OF DIMMING APPARATUS 50 (FIG.2) | $V_{in}$ | $A_{in}$ | $W_{in}$ | PF | $V_{lp}$ | $A_{lp}$ | $W_{lp}$ | $V_c$ | WATTS LOSS | REG. |
|---|---|---|---|---|---|---|---|---|---|---|
| FULL OUTPUT | 277 | 1.730 | 470 | 0.981 | 136.9 | 3.177 | 404 | 427.7 | 66 | |
| OCV - 315.3V | 291 | 1.668 | 481 | 0.992 | 136.9 | 3.248 | 413 | 433.5 | 68 | 2% |
| SCA - 3.694A | 305 | 1.706 | 493 | 0.947 | 137.0 | 3.317 | 421 | 439.1 | 72 | 4% |
| LIGHT OUTPUT - 100 | 263 | 1.826 | 458 | 0.952 | 136.5 | 3.090 | 393 | 420.2 | 65 | -3% |
| LAMP CURRENT CF - 1.64 | | | | | | | | | | |
| DIP = 110V | 249 | 1.908 | 441 | 0.926 | 136.1 | 2.983 | 379 | 411.2 | 62 | -6.2% |
| | | | | | | | | | | |
| DIMMED | 277 | 1.362 | 283 | 0.748 | 126.1 | 2.174 | 246 | 239.5 | 37 | |
| OCV - 294.3V | 291 | 1.552 | 304 | 0.674 | 127.1 | 2.302 | 264 | 248.7 | 40 | 7.3% |
| SCA - 2.509A | 305 | 1.822 | 329 | 0.593 | 128.8 | 2.427 | 284 | 258.3 | 45 | 15.5% |
| LIGHT OUTPUT - 39 | 263 | 1.236 | 262 | 0.802 | 125.7 | 2.038 | 228 | 230.7 | 34 | -7.3% |
| LAMP CURRENT CF - 1.59 | | | | | | | | | | |
| DIP = 173V | 249 | 1.135 | 238 | 0.845 | 125.1 | 1.901 | 209 | 221.6 | 29 | -15.0% |

*FIG. 3*

| OPERATING CHARACTERISTICS OF VARIOUS STEP DIMMING CIRCUITS | % INPUT WATTS REDUCTION | $V_{in}$ | $A_{in}$ | $W_{in}$ | PF | $V_{lp}$ | $A_{lp}$ | $W_{lp}$ | WATTS LOSS | % LAMP WATTS |
|---|---|---|---|---|---|---|---|---|---|---|
| DIMMING CIRCUIT 50 (FIG.2) | | | | | | | | | | |
| (NORMAL) | NONE | 277 | 1.73 | 470 | .981 | 136.9 | 3.18 | 404 | 66 | 100% |
| (DIMMED) | 40% | 277 | 1.36 | 283 | .75 | 126.1 | 2.17 | 246 | 37 | 60.9% |
| | | | | | | | | | | |
| DIMMING CKT WITH CWA/PLA-TYPE BALLAST | | | | | | | | | | |
| (NORMAL) | NONE | 480 | 0.98 | 464 | .99 | 132.8 | 3.25 | 401 | 63 | 100% |
| (DIMMED) | 38.9% | 480 | 0.61 | 284 | .96 | 121.3 | 2.24 | 241.7 | 42.3 | 60.3% |
| | | | | | | | | | | |
| DIMMING CKT WITH REACTOR (FIG.1) | | | | | | | | | | |
| (NORMAL) | NONE | 217 | 1.76 | 473 | .97 | 139 | 3.24 | 406 | 67 | 100% |
| (DIMMED) | 34.5% | 277 | 1.40 | 310 | .80 | 125.5 | 2.24 | 253 | 57 | 37.7% |

*FIG. 4*

APPARATUS FOR DIMMING DISCHARGE LAMP HAVING ELECTROMAGNETIC REGULATOR WITH SELECTIVELY TAPPED CAPACITANCE WINDING

FIELD OF THE INVENTION

The present invention relates to an apparatus for dimming a discharge lamp using an electromagnetic regulator ballast.

BACKGROUND OF THE INVENTION

A number of continuous wattage autotransformers (CWAs) and peak lead autotransformers (PIAs) have been used as ballasts for gas discharge lamps such as high pressure sodium (HPS) lamps and metal halide (MH) lamps. These types of ballasts, however, do not exhibit the overall superior performance desired for some lighting applications such as the illumination of large industrial facilities and roadways where fixtures are elevated and/or spaced far apart and are otherwise difficult for service personnel to reach for maintenance purposes. Accordingly, a number of customers desire a better quality ballast, such as an electromagnetic regulator, for these types of applications. Although electromagnetic regulators can be twice as expensive as CWA/PLA-type ballasts, a number of customers are willing to incur the additional expense to use electromagnetic regulators in lieu of CWA/PLA-type ballasts for lighting applications requiring superior ballast performance.

An electromagnetic regulator transfers energy from a primary winding connected to a power source to a tertiary or capacitive winding. The electromagnetic regulator then transfers energy in the tertiary winding to a secondary winding connected to a lighting fixture. Unlike other ballasts, the windings in an electromagnetic regulator are isolated. The tertiary winding regulates the volt-amperes in the regulator and can be manipulated to change flux levels in the core of the regulator. Thus, the tertiary or capacitance winding processes energy in the core, whereas the capacitance in other types of ballasts represent merely a lamp current limiting impedance.

Electromagnetic regulator circuits for discharge lamps are disclosed in U.S. Pat. Nos. 4,891,562 and 5,216,333, to Nuckolls et al, which are both hereby incorporated herein by reference in their entirety. The circuit disclosed in U.S. Pat. No. 4,891,562 uses an electromagnetic regulator having primary, secondary and tertiary windings connected to an alternating current (AC) power source, a lamp and a control circuit, respectively. The control circuit comprises an inductive reactor, a timer, a reference signal circuit, a comparator circuit, a direct current supply circuit and a semiconductor switch. The firing angle of the switch is controlled to regulate the operating characteristics of the lamp to compensate for line voltage changes, lamp aging effects and other variations. While the circuit is desirable for a number of reasons, the circuit uses a considerable number of components and is therefore costly.

The circuit disclosed in U.S. Pat. No. 5,216,333 is depicted in FIG. 1. The circuit is a step-dimming apparatus for a discharge lamp 22 having an electromagnetic regulator 10. The electromagnetic regulator 10 comprises primary, secondary and tertiary windings 12, 14 and 16, respectively, coupled together by a laminated core 18. The primary winding 12 is connected to an alternating current (AC) power source. The secondary winding 14 is connected to the discharge lamp 22 via a starting circuit 21. The tertiary winding 16 is connected to a capacitor 24 and is the capacitance winding of the regulator 10.

With further reference to FIG. 1, the tertiary winding 16 is provided with a center tap 26 for operating a reactor 30. The reactor 30 is connected in series with a normally closed contact set 32 in a switchable conductive path extending between one end of the winding 16 and the tap 26, that is, across one-half of the winding 16. When an actuator such as relay 28 opens the contact set 32, the reactor 30 has no effect on the lamp. When the contact set 32 is closed, the reactor 30 extracts positive volt-amperes and stores energy each half-cycle, thereby reducing the amount of energy stored in the capacitor 24. Accordingly, the energy available to the lamp is reduced and the lamp is dimmed.

The dimming circuit disclosed in U.S. Pat. No. 5,216,333, although desirable for a number of reasons, can also be too costly and too large for some applications, particularly due to the use of the reactor 30. A need exists for a dimming circuit having an electromagnetic regulator which avoids the need for an additional magnetic device such as a reactor, yet reduces the operating wattage level of a discharge lamp without creating lamp instability or power supply line problems.

SUMMARY OF THE INVENTION

In accordance with an aspect of the present invention, a dimming apparatus for a discharge lamp is provided which requires a minimum number of components and, in particular, no additional magnetic devices such as a reactor.

In accordance with another aspect of the present invention, an apparatus for dimming a discharge lamp is provided comprising an electromagnetic regulator. The electromagnetic regulator has a primary winding connected to an AC power supply, a secondary winding connected to the lamp and a tertiary winding. A capacitor is selectively connected to a tap on the tertiary winding via a switching device for dimming purposes.

In accordance with yet another aspect of the present invention, the tertiary winding has a number of taps to which the capacitor can be connected, depending on the level of dimming desired.

BRIEF DESCRIPTION OF THE DRAWINGS

These and other features and advantages of the present invention will be more readily apprehended from the following detailed description when read in connection with the appended drawings, which form a part of this original disclosure/and wherein:

FIG. 3 is a table comprising data relating to the operating characteristics of the dimming apparatus constructed in accordance with an embodiment of the present invention using different line voltages; and FIG. 4 is a table comprising data relating to the operating characteristics of a dimming apparatus constructed in accordance with an embodiment of the present invention, the dimming circuit depicted in FIG. 1, and a dimming circuit comprising a CWA/PLA-type ballast.

DETAILED DESCRIPTION OF THE PREFERRED EMBODIMENT

Figure 2:
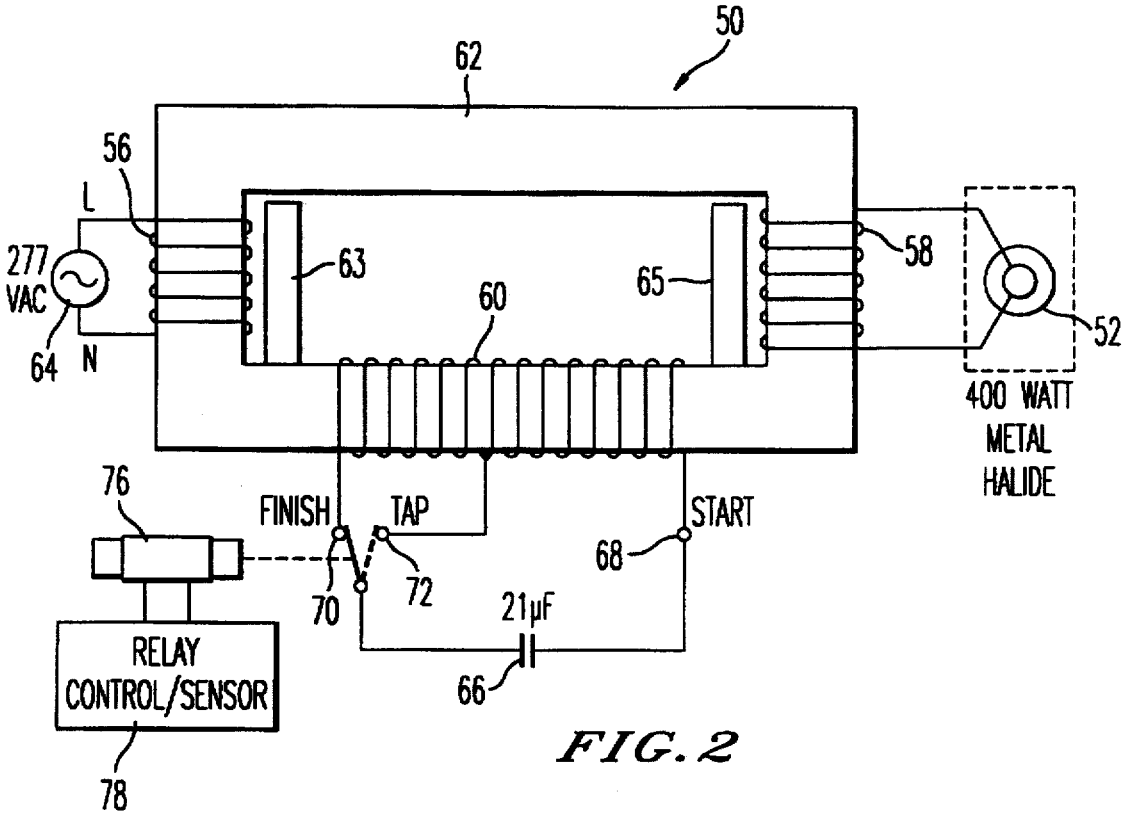
FIG. 2 is a schematic diagram of a dimming apparatus for a discharge lamp constructed in accordance with an embodiment of the present invention.

As shown in FIG. 2, a dimming apparatus 50 constructed in accordance with the present invention is provided for a discharge lamp 52. For illustrative purposes, the discharge lamp 52 is a 400 watt metal halide lamp, although other types and sizes of discharge lamps can be used.

The dimming apparatus 50 comprises an electromagnetic regulator (e.g., a Model 71A6044 480-volt regulator available from Advance Transformer, Inc., Rosemont, Ill.) having a primary winding 56, a secondary winding 58 and a tertiary winding 60. The three windings 56, 58 and 60 are magnetically coupled together by a laminated core 62. The primary winding 56 has line and neutral wires L and N connectable to an AC power source 64. The power source 64 is depicted as a 277 volt AC power source for illustrative purposes; however, other input line voltages can be used. Further, other types of magnetic regulators can be used, depending on the type of lamp and wattage used. The lamp 52 is connected to the secondary winding 58. The core 62 is preferably provided with magnetic shunts 63 and 65 across the primary and secondary windings 56 and 58, respectively, with gaps as shown in FIG. 2.

With continued reference to FIG. 2, a capacitor 66 is connected at one terminal thereof to an end 68 of the winding 60 labeled "START". In accordance with the preferred embodiment of the present invention, the other terminal of the capacitor 66 is selectively connected to one of at least two different terminals, that is, a first terminal being the opposite end 70 of the tertiary winding and labeled "FINISH" and the other being an intermediate tap 72 on the tertiary winding 60. The dimming apparatus 50 uses a switching device 76 on the tertiary winding 60 to selectively connect the capacitor to the end 70 of the winding 60 or to the tap 72. Other taps can be provided on the winding 60 in addition to the tap 72.

The switching device 76 is illustrated as a relay operated by a relay control device 78. The switching device 76 is preferably of the type that is capable of responding to a sensed condition such as motion of a person in the field of view of a sensor associated with the relay control device 78. It is to be understood, however, that other types of switches can be used to control where along the winding 60 the capacitor 66 is connected, such as a slide switch, a press switch, a semiconductor switch, an optocoupler, a thyristor, or any other mechanical, electromechanical or electronic device for opening and closing a circuit. Alternatively, two or more switching devices can be used to connect the capacitor 66 to one of several possible taps, depending on the amount of dimming desired.

When the switching device 76 is activated, one terminal of the capacitor 66 is disconnected from the end 70 of the tertiary winding 60 and is connected to the tap 72. Thus, the magnetic coupling of the winding 60 with the core 62 is effectively reduced in proportion to the location of the tap 72 with respect to the START end 68 of the winding 60. Accordingly, the flux level in the core 62 and the energy provided to the lamp 52 via the secondary winding 58 is reduced to operate the lamp 52 dimmed state. The lamp 52 operates at full wattage operation again after the relay 76 is no longer activated or disengaged and the end of the capacitor 66 is disconnected from the tap 72 and connected once again to the end 70 of the winding 60.

The value of the capacitor 66 and the location of the tap 72 along the capacitance winding 60 varies, depending on the type and size of the lamp 52 and, correspondingly, the size of the electromagnetic regulator 54 used in the circuit 50. The values can be determined empirically. For example, if a 400-watt metal halide lamp 52 and a 480-watt electromagnetic regulator are used, the capacitor 66 is preferably 21 microfarads (μF) and the tap 72 is preferably at the 336-volt or approximately 70% location from the "START" terminal 68 on the tertiary winding 60 to achieve desirable lamp operating characteristics. The operating characteristics for such a dimming circuit are provided in FIG. 3 for a number of input line voltages in both the full wattage and dimmed states. In the dimmed mode, the line dip tolerance is greater than approximately 36%, which is as good as that of a CWA/PLA-type dimming circuit during full wattage operation. The lamp operating crest factor is 1.59 which promotes longevity of lamp life and maintenance of high lumen output. The lamp stabilizing open circuit voltage (OCV) decreases only 6.6% in the dimmed mode. In addition, lamp wattage remains good (i.e., ±15%) in the dimmed mode.

Figure 1:
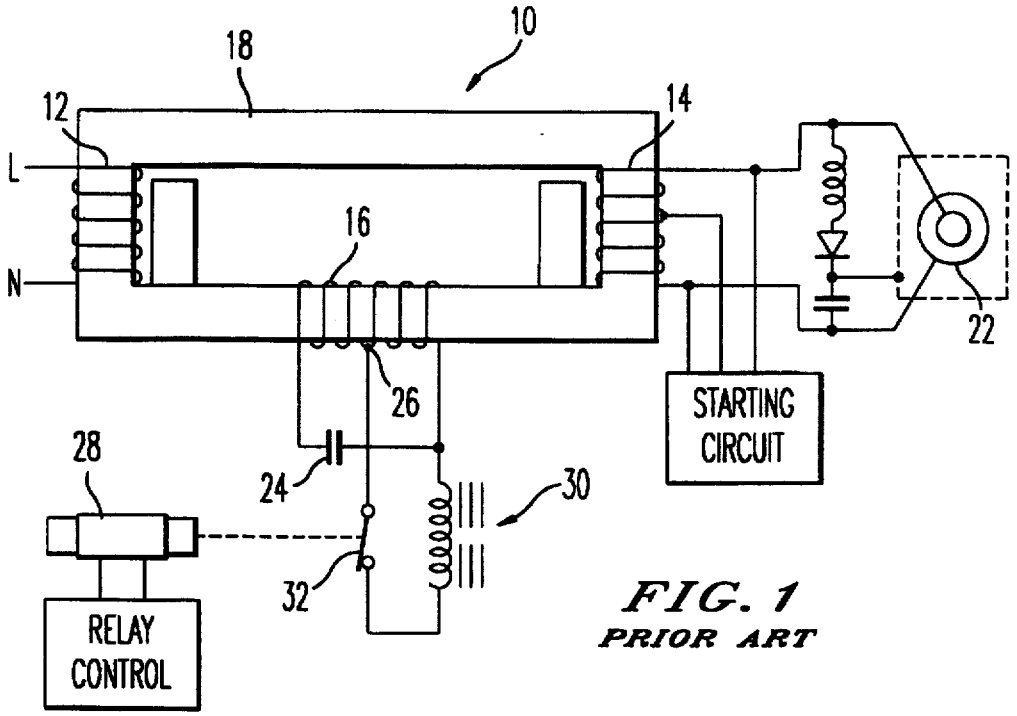
FIG. 1 PRIOR ART
FIG. 1 is a schematic circuit diagram of a prior art dimming circuit for a discharge lamp connected to a electromagnetic regulator.

Operating characteristics for the dimming apparatus 50 of the present invention and two other types of circuits are provided in FIG. 4 to illustrate the superior performance of the dimming apparatus 50. The dimming apparatus has only a 37 watts loss in a dimmed state, as compared with a 42.3 watts loss associated with a CWA/PLA-type dimming circuit. A dimming circuit having a reactor between a 240 volt tap and the input of a winding (e.g., the circuit depicted in FIG. 1) is more inefficient than the dimming apparatus 50 of the present invention and the CWA/PLA-type dimming circuit, as indicated by its operating losses of 57 watts. These losses are due to a portion of energy in the tertiary winding of the ballast being displaced to the reactor 30, as opposed to being supplied to the lamp 22.

The power factor of the dimming apparatus 50 (i.e., 0.75) is lower than the 0.96 power factor of the CWA/PLA-type dimming circuit when in a dimmed state. The overall operating characteristics of the dimming apparatus are nonetheless superior. The lower power factor associated with the dimming circuit 50 of the present invention is not problematic because most power delivery systems for a building or other facility are designed to manage a full wattage state of operation. Further, in both the dimming apparatus of the present invention and the CWA/PLA-type dimming circuit, the reduction in input power when switched from a full wattage operation mode to a dimmed mode is approximately the same (i.e., approximately 40%).

The dimming apparatus 50 of the present invention achieves superior performance, as demonstrated by the data in FIG. 4, yet requires no additional magnetic components such as a reactor. The dimming apparatus 50 is therefore more efficient than dimming circuits that use reactors or CWA/PLA-type dimming circuits. Further, the dimming apparatus 50 is less costly than dimming circuits such as the circuit depicted in FIG. 1 since it uses fewer components.

While only one advantageous embodiment has been chosen to illustrate the invention, it will be understood by those skilled in the art that various changes and modifications can be made herein without departing from the scope of the invention as defined in the appended claims.

What is claimed is:

1. A step-dimming apparatus for a discharge lamp comprising the combination of:

a discharge lamp;

an electromagnetic regulator having a primary winding, a secondary winding, a tertiary winding and a magnetic core for linking said windings, said lamp being connected to said secondary winding, said tertiary winding having a first end, a second end, and a first tap between said first end and said second end thereof;

an alternating current power source connected to said primary winding;

a capacitor having a first terminal connected to said first end of said tertiary winding and a second terminal connected to said second end of said tertiary winding; and a switching device for disconnecting said second terminal of said capacitor from said second end of said tertiary winding and connecting said second terminal of said capacitor to said first tap when activated to reduce power available to said discharge lamp.

2. A step-dimming apparatus as claimed in claim 1, wherein said tap is located at a predetermined point along said tertiary winding which is selected in accordance with operating characteristics of said discharge lamp to allow for dimming of said discharge lamp while maintaining substantially efficient operation of said discharge lamp.

3. A step-dimming apparatus as claimed in claim 1, further comprising a second tap on said tertiary winding, said switching device being operable to connect said another end of said capacitor to one of said tap and said second tap to dim said discharge lamp to one of two respective dimmed levels.

4. A step-dimming apparatus as claims in claim 1, wherein said switching device is selected from the group consisting of a slide switch, a press switch, a semiconductor switch, an optocoupler, a thyristor, and a relay.

5. A step-dimming apparatus as claims in claim 1, wherein said switching device is coupled to a sensor and is actuated in response to output signals generated by said sensor.

6. A step-dimming apparatus as claims in claim 1, wherein said sensor is selected from the group consisting of a motion sensor and a light level sensor.

7. A method for dimming a discharge lamp comprising the steps of:

supplying power from an alternating current power source to said discharge lamp via an electromagnetic regulator; and switching one terminal of a capacitor connected across a winding on said electromagnetic regulator to a tap located at an intermediate point on said winding to reduce power supplied to said discharge lamp via said electromagnetic regulator.

* * * * *